United States Patent [19]

Lafstidis

[11] Patent Number: 4,793,642

[45] Date of Patent: Dec. 27, 1988

[54] VEHICLE DOOR LOCK HANDLE FOR DETERING THEFT OF A VEHICLE

[76] Inventor: John Lafstidis, 47 Everett St., Everett, Mass. 02149

[21] Appl. No.: 31,026

[22] Filed: Mar. 27, 1987

[51] Int. Cl.[4] ..... E05B 1/00; E05C 13/02

[52] U.S. Cl. ..... 292/336.3; 292/347; 292/1

[58] Field of Search ..... 292/1, 336.3, 347, DIG. 61; 16/121

[56] References Cited

U.S. PATENT DOCUMENTS

| | | | |
|---|---|---|---|
| 2,775,498 | 12/1956 | Gettel | 292/76 |
| 2,853,332 | 9/1958 | Skutnik | 292/347 |
| 3,558,168 | 1/1971 | Andres | 292/347 |
| 3,790,199 | 2/1974 | Ballou | 292/1 |
| 4,098,529 | 7/1978 | Bingham | 292/347 |
| 4,169,620 | 10/1979 | Pacura | 292/347 |
| 4,183,569 | 1/1980 | Landfried et al. | 292/347 |

FOREIGN PATENT DOCUMENTS

| | | | |
|---|---|---|---|
| 2508451 | 4/1975 | Fed. Rep. of Germany | 292/347 |
| 2349817 | 9/1976 | Fed. Rep. of Germany | 292/347 |
| 1393165 | 12/1965 | France | 16/121 |

*Primary Examiner*—Gary L. Smith
*Assistant Examiner*—Eric K. Nicholson
*Attorney, Agent, or Firm*—Joseph S. Iandiorio; Douglas E. Denninger

[57] ABSTRACT

An elongated handle having an interior coil spring and a flexible jacket positioned over the spring is screwed into a terminal portion of a conventional automobile door lock actuation mechanism. The application of lateral forces to the handle by a thief will cause the handle to be bent owing to its high lateral compliance in directions transverse to the longitudinal axis of the handle, to prevent a thin, manually actuated tool from grasping the handle to a sufficient extent to enable the lock to be "popped" open.

6 Claims, 1 Drawing Sheet

VEHICLE DOOR LOCK HANDLE FOR DETERING THEFT OF A VEHICLE

BACKGROUND OF THE INVENTION

The present invention relates to the field of locking devices for vehicles such as automobiles.

Conventional door lock handles for automobiles consist of elongated members which protrude from the top sill of an auto door. The door locking mechanisms are actuated by pushing downwardly upon the elongated handle to lock the automobile, and conversely, pulling upwardly upon the elongated handle releases the door lock mechanism. The widespread theft of automobiles has been readily performed for many years by slipping thin, elongated tools into the interior of the vehicle, which are utilized to "pop" open the door locks by contacting side portions of the elongated handles and applying lateral forces thereto. In one mode, a wire hanger is slipped between the uppermost edge of the window and the door frame and is lowered until it contacts side portions of the handle. The hanger is manipulated so that an end portion thereof, which is often looped, is able to grasp side portions of the handle to a sufficient extent to enable the handle to be pulled upwardly to release the lock. In a second mode of operation, an elongated tool such as a screwdriver is inserted within a crack between the door and the frame of the vehicle, and the tip of the screwdriver is pressed against side portions of the handle by the thief, and this action produces a sufficient vertical force component to pop the vehicle lock open by displacing the elongated handle in the vertical upward direction.

It is thus an object of the present invention to provide a simple and inexpensive vehicle door lock handle which substantially deters the theft of automobiles in the manner described above.

It is a further object of the invention to provide a novel door lock handle which is inexpensive to manufacture, and may readily replace conventional door lock handles to protect the vehicles.

SUMMARY OF THE INVENTION

In accordance with a preferred embodiment of the invention, an elongated handle is provided, having an interior coil spring and a flexible jacket positioned over the coil spring to form a handle which may be screwed into a terminal portion of the conventional door lock actuation mechanism in a very short period of time. The application of lateral forces mentioned above will cause the handle to be bent owing to its high lateral compliance in directions transverse to the longitudinal axis of the handle to prevent a thin, manually actuated tool from grasping the handle at side portions thereof along its length to a sufficient extent to enable the lock to be "popped" open. The non-rigid jacket positioned about the coil spring, retains the high lateral compliance and yet prevents the elongated tool from being inserted through the coil spring to permit the handle to be readily displaced upwardly to unlock the vehicle lock.

Other objects, features and advantages of the present invention will become apparent upon study of the following detailed description taken in conjunction with the drawings in which.

DETAILED DESCRIPTION

Figure 1:
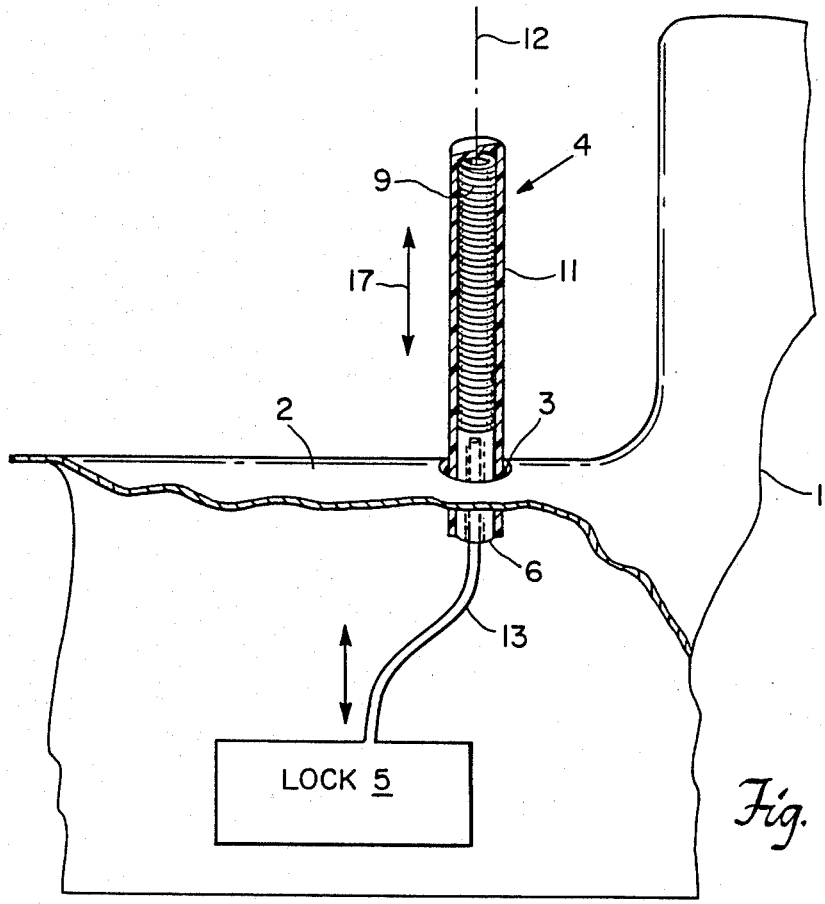
FIG. 1 illustrates a preferred embodiment of the invention.
Figure 2:
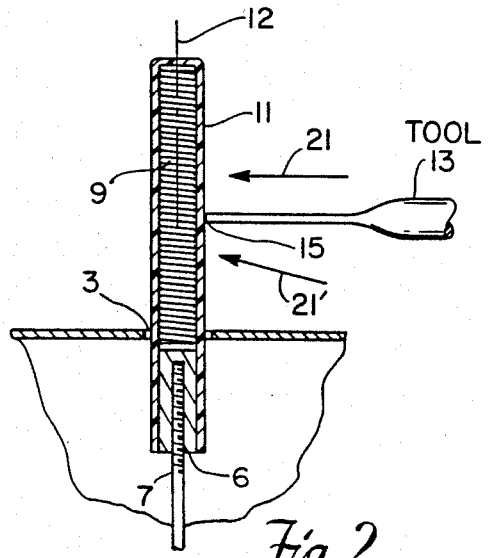
FIGS. 2 and 3 illustrate the lateral displacement of the handle to substantially deter theft of the motor vehicle.

In FIG. 1, a car door 1 having a sill 2 thereon with an orifice 3 therein, contains terminal portion 6 of my novel handle, which terminal portion passes through orifice 3. The preferred embodiment comprises an ordinary coil spring 9, which surrounds longitudinal axis 12 as illustrated, the coil spring having a jacket 11 made of a flexible non-rigid material which could be rubber or plastic, and which is slipped over coil spring 9. Terminal portion 6 of the novel handle 4 is coupled to lock 5 via the conventional intermediate member 13 as illustrated. Lock 5 is actuated by pressing downwardly in the direction indicated by arrow 17 to lock the vehicle. In the locked mode the entire terminal portion 6 of handle 4 is positioned beneath the surface of the sill as illustrated in FIG. 2. Lock 5 is unlocked by manually pulling upon handle 4 in the upward direction parallel to the longitudinal axis 12. The lower spring portion is welded or otherwise affixed to tubular female threaded terminal portion 6, screwed over male screw 5.

Figure 3:
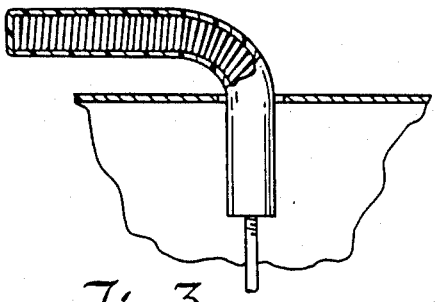

Referring now to FIG. 2, the aforesaid tool 13 such as a screwdriver may be slipped between the crack of door 1 and the vehicle frame, and a force is applied by the thief against side portions of handle 4 in the direction generally indicated by arrow 21. Owing to the high lateral compliance of the resilient coil spring and its flexible protective jacket 11, a lateral force asserted in the direction of 21 (or in a slightly upward direction indicated by arrow 21') will cause the novel handle to assume curved, bent configurations similar to that configuration shown in FIG. 3, which in turn renders it virtually impossible for the tip 15 of the tool 13 to grasp a side portion of the handle to a sufficient extent to cause an upward force component to be asserted against the handle which is great enough to pop open the lock. The use of the aforesaid wire hanger will produce a similar ineffective result. The novel handle 4 preferably is resilient so that upon the removal of tool 13 from contact with the handle, the handle will again assume the vertically oriented positions shown in FIGS. 1 and 2. However, it is within the scope of the invention to provide a non-resilient elongated handle which could retain a bent orientation upon removal of tool 13, although this is far less preferred then a laterally resilient handle described above. With a non-resilient handle, the operator of the vehicle would have to grasp the handle and twist it upwardly into the vertical position before opening the lock. Because the non-resilient handle is flexible, however, it still yields to further manipulations by a thief and continues to defeat a break-in attempt. It should be noted that the flexible jacket 11 prevents the tool 13, which would typically be a screwdriver, from entering spaces between a pair of coils of the spring which would enable the spring to be displaced vertically. At the same time, the jacket hides the relatively unesthetic appearance of the coil spring. The illustrated embodiment is thus constituted to enable it to be readily bent laterally upon the application of relatively low forces to side portions thereof owing to its relatively high lateral compliance. Furthermore, the illustrated elongated member, under the influence of tool 13, will be bent into a partially curved configuration by forces applied along the entire length of the handle. The term "high lateral compliance" as used herein means that a relatively low lateral force (e.g. several pounds or less) applied to the handle would be sufficient to cause the novel handle to be bent to a sufficient extent to prevent effective grasping by a tool such as a screwdriver or terminal portion of a wire hanger.

While preferred embodiments have been illustrated and described above, it should be understood that the scope of the invention is to be restricted only by the terms of the following claims and art recognized equivalents thereof. For example, it is within the scope of the invention to utilize a member such as rubber tubing which has high lateral compliance and yet could be utilized to open and close the lock. Also substantial portions of the interior of the jacketed handle could be rigid and be coupled to lower portions via a short spring member which would still enable bending at a limited portion of the handle.

What is claimed is:

1. A door lock handle highly flexible in all directions transverse to its longitudinal axis for locking and unlocking a vehicle door lock, comprising an elongated handle having sufficient stiffness along said longitudinal axis to enable transmission of manually applied forces to said handle substantially parallel to said longitudinal axis to lock and unlock said door lock, and having high lateral compliance in directions transverse to said longitudinal axis to yield when a relatively low lateral force is applied to said handle to prevent a tool from engaging said handle and unlocking said vehicle door lock, said handle including a cylindrical coil spring positioned along at least a portion of said longitudinal axis, and a flexible jacket positioned about said coiled spring for preventing said tool from being inserted through said coil spring while enabling bending of said handle in said transverse directions.

2. The door lock handle of claim 1 in which said cylindrical coil spring extends along substantially the entire length of said longitudinal axis.

3. The door lock handle of claim 1 in which said handle is resilient.

4. The door lock handle of claim 1 further including fastening means positioned upon a terminal portion of said handle enabling the replacement of a conventional elongated door lock handle with said non-directional flexible handle.

5. A door lock handle highly flexible in all directions transverse to its longitudinal axis for locking and unlocking a vehicle door lock, comprising an elongated, resilient handle having sufficient stiffness along said longitudinal axis to enable transmission of manually applied forces to said handle parallel to said longitudinal axis to lock and unlock said door lock, and having high lateral compliance in directions transverse to said longitudinal axis to yield when a relatively low lateral force is applied to said handle to prevent a tool from engaging said handle and unlocking said vehicle door lock, said handle including a cylindrical coil spring extending along the entire length of said longitudinal axis, and a flexible jacket positioned about said coiled spring for preventing said tool from being inserted through said coil spring while enabling bending of said handle in said transverse directions.

6. The door lock handle of claim 5 further including fastening means positioned upon a terminal portion of said handle enabling the replacement of a conventional door lock handle with said elongated handle.

* * * * *